US006989525B2

(12) United States Patent
Howard

(10) Patent No.: US 6,989,525 B2
(45) Date of Patent: Jan. 24, 2006

(54) METHOD FOR USING VERY SMALL PARTICLES AS OBSCURANTS AND TAGGANTS

(75) Inventor: Robert James Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 252 days.

(21) Appl. No.: 10/437,813

(22) Filed: May 14, 2003

(65) Prior Publication Data

US 2004/0227112 A1 Nov. 18, 2004

(51) Int. Cl.
*H01J 40/14* (2006.01)

(52) U.S. Cl. ..... 250/221; 250/559.29

(58) Field of Classification Search ..... 250/221, 250/559.38, 559.29, 495.1, 338.1, 342; 102/334, 102/336, 505

See application file for complete search history.

(56) References Cited

U.S. PATENT DOCUMENTS 4,053,433 A 10/1977 Lee
4,448,106 A 5/1984 Knapp
5,324,567 A 6/1994 Bratchley et al.
5,401,976 A * 3/1995 Bannasch ..... 250/495.1
6,380,547 B1 4/2002 Gonzalez et al.
6,388,246 B1 5/2002 Fry et al.
6,432,715 B1 8/2002 Nelson et al.
6,484,640 B1 * 11/2002 Schneider et al. ..... 102/334

* cited by examiner

*Primary Examiner*—Que T. Le
(74) *Attorney, Agent, or Firm*—DeMont & Breyer, LLC

(57) ABSTRACT

A method is disclosed wherein engineered particles are used as obscurants and taggants for vehicles. In some embodiments, the engineered particles are nano-crystals or microspheres (doped or un-doped). In some embodiments, the particles are engineered to re-radiate the energy that they receive at either the same wavelength or a different wavelength than that of the incident photons. Particles that scatter light at the same wavelength as the interrogating beam are advantageously used as taggants. Particles that scatter light at a different wavelength as the interrogating beam are advantageously used as obscurants. In some embodiments, the method comprises storing a quantity of particles in a first vehicle, and releasing a portion of the particles in an ambient environment of the first vehicle.

34 Claims, 6 Drawing Sheets

METHOD FOR USING VERY SMALL PARTICLES AS OBSCURANTS AND TAGGANTS

FIELD OF THE INVENTION

The present invention relates to a method for obscuring or marking objects, such as land, air or seafaring vessels.

BACKGROUND OF THE INVENTION

Lasers are now commonly used for tactical designation, detection and ranging. Laser-based tactical systems can be used to detect many types of military vehicles, including submarines, ships, land vehicles and aircraft.

There are two types of laser-based systems. One type is "LIDAR," which typically uses laser pulses and is fully analogous to RADAR. The other is "laser designation," wherein the target is illuminated with a continuous beam or pulse train. LIDAR systems obtain range and bearing, while laser designating systems use reflected laser energy (possibly from a third platform) to home on the target.

FIG. 1 depicts a conventional scenario involving a target vehicle 122, which is moving in direction 124, and LIDAR system 120, which is capable of detecting and ranging the target vehicle. In operation, LIDAR system 120 emits a beam of laser light 126 having a specific wavelength $\lambda_1$ (e.g., an infrared wavelength, etc.) toward target vehicle 122. When it impinges on target vehicle 122, the light is reflected to LIDAR system 120. A sensor in the LIDAR system detects reflected light 128 at wavelength $\lambda_1$. Processing electronics within LIDAR system 120 ranges target vehicle 122 using, for example, the round-trip time of light beams 126 and 128.

In order to avoid detection or frustrate attempts at ranging by such systems, military vehicles often use "obscurants" to obscure their presence. But relatively few obscurants are effective against LIDAR or laser-designation systems. In fact, obscurants for these laser-based systems are typically limited to classical systems, such as smoke and water spray (for ships). And while somewhat effective for use by aircraft and land vehicles, smoke is generally not available for use as an obscurant for submarines.

Consequently, there is a need to develop new obscurants and a method to use them to bolster the limited arsenal of countermeasures available against LIDAR and laser-designation systems. And for obvious reasons, there is a continuing need to develop better "taggants" that tag vehicles to facilitate their detection and ranging.

SUMMARY OF THE INVENTION

The illustrative embodiment of the present invention is a method that avoids at least some of the drawbacks of the prior art. In accordance with the method, engineered particles are used as obscurants and taggants. In some embodiments, the method comprises:

storing a quantity of particles in a first vehicle; and releasing a portion of the particles in an ambient environment of the first vehicle.

Engineered particles suitable for use in conjunction with a method in accordance with the illustrative embodiment of the present invention include, without limitation, nanometer-scale crystals and micron-scale spheres. In some embodiments, the nanometer-scale crystals, and doped versions of the micron-scale spheres, are advantageously engineered to absorb photons having a first, predetermined wavelength $\lambda_1$ and re-radiate (fluoresce) the absorbed energy as photons having a second wavelength $\lambda_2$. In some other embodiments, the micron-scale spheres remain un-doped, and simply scatter the light that they receive without a change in wavelength. Particles that shift wavelength on re-radiation are advantageously (but not necessarily) used as obscurants. On the other hand, particles that do not shift the wavelength of re-emitted energy are advantageously (but not necessarily) used as taggants.

Consider a first vehicle that has deployed particles in accordance with the illustrative embodiment of the present invention, wherein the particles absorb light having wavelength $\lambda_1$ and fluoresce at a second wavelength $\lambda_2$. Assume that a LIDAR or laser designation system directs a beam of light having wavelength $\lambda_1$ toward the first vehicle, wherein the light impinges upon the particles before it can reach the vehicle. The particles will absorb the light and re-radiate the energy at wavelength $\lambda_2$. Since light having a wavelength other than $\lambda_1$ will not be properly sensed and interpreted by the LIDAR or the laser-designation system, the particles, and the first vehicle that they shield, will remain undetected. In this fashion, the particles function as an obscurant.

Consider a first vehicle that has deployed particles in accordance with the illustrative embodiment of the present invention, wherein the particles receive and scatter light at the same wavelength $\lambda_1$. Assume that a second vehicle passes through or near the released particles, and that the medium through which the vehicle travels (and in which the particles are suspended) is disturbed by the passage of the second vehicle. Assume further that an LIDAR system directs a beam of light having wavelength $\lambda_1$ toward the second vehicle, wherein the light impinges upon the particles. Light having wavelength $\lambda_1$ that is scattered by the particles is detected by the LIDAR system. The detected light reveals that the particles are moving in a characteristic fashion, indicative of the passage of a specific type of vehicle (e.g. submarine, aircraft, etc). In this fashion, the particles function as a taggant.

In some further variations of the illustrative embodiment, the particles are adhered to vehicle. In some of these variations, the particles are treated to become "sticky" on release from a first vehicle. When the particles come into contact with a second vehicle, the particles adhere to that vehicle, functioning as a taggant.

In yet some additional variations of the illustrative embodiment, the particles are incorporated into a paint, which is then adhered to a vehicle. In embodiments in which the particles absorb and fluoresce at different wavelengths, the particle-laden paint serves as an obscurant to prevent a painted vehicle from being detected.

These and other variations of the illustrative embodiment of the present invention are depicted in the Drawings and described further below in the Detailed Description.

DETAILED DESCRIPTION

Figure 1:
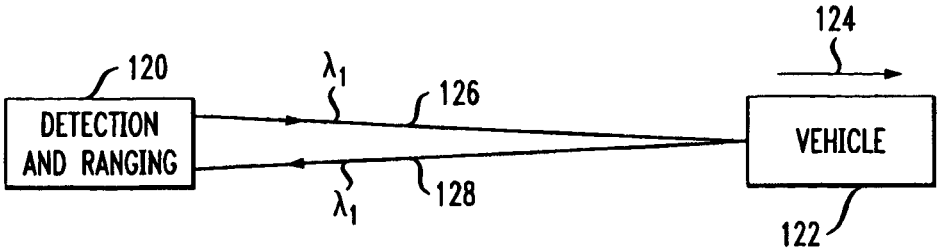
FIG. 1 PRIOR ART
FIG. 1 depicts a (conventional) manner in which an LIDAR system interrogates a target vehicle.

The terms listed below are defined for use in this specification as follows:

Laser-based Detection and Ranging (LDR) Systems. As used herein, this phrase generically refers to both LIDAR systems and laser designation systems. That is, the illustrative embodiments of the invention can be used, as appropriate, in conjunction with either type of system. LIDAR and laser designation systems are well known to those skilled in the art and will not be described here in detail. It will suffice to note that LIDAR is capable of generating a beam of laser light having a specific wavelength, directing the beam toward a target, detecting a beam having the same wavelength that is reflected from the target, and ranging the target. Laser designation systems "illuminate" a target for a missile to home on. For clarity and simplicity, the illustrative embodiment of the present invention is described and illustrated in the context of LIDAR systems. Those skilled in the art will know how, and know when it's appropriate to use the illustrative embodiment of the invention with either type of system.

Micron-scale means greater than about 100 nanometers and less than about 10 microns.

Nanometer-scale means about 100 nanometers or smaller.

Obscurant is something that obscures the presence of a vehicle from a system that is trying to detect or range the vehicle.

Resonant Cross Section refers to the interaction cross section of a particle near a resonant frequency of the particle.

Taggant is something that enhances the ability of a system to detect or range a vehicle.

Vehicle means devices, typically military, which are capable of moving personnel, ordinance, supplies, etc. Vehicles include, without limitation, land vehicles (e.g., tanks, armored personal carriers, etc.), aircraft (e.g., helicopters, jets, prop-planes, drones, missiles, etc.), and seafaring vessels (e.g., submarines, surface ships, etc.).

The illustrative embodiment of the present invention is a method for using very small particles—particles having a size of about 10 microns or less—as obscurants and taggants for use in conjunction with LDR systems. When used as obscurants, the particles are capable of defeating LDR systems. When used as taggants, the particles are capable of enhancing the performance of these systems.

An important aspect of the present invention is the selection of particles for use as obscurants or taggants. Particles for use in conjunction with the illustrative embodiment of the present invention are advantageously:

- nanometer-scale crystals and slightly-larger scale crystals (i.e., greater than 100 nanometers and typically less than about 1000 nanometers), which are collectively referred to in this specification as "nano-crystals;" and
- micron-scale transparent spheres.

It is recognized that, typically, the term "nano-crystal" refers to crystals having a size less than about 100 nm. As will become clear later in this specification, in some embodiments of the present invention, crystals that are larger than 100 nm or even 500 nm are advantageously used. It is immaterial whether these crystals are referred to as "oversized nano-crystals," "micro-crystals," "nano-crystals," or something else. For convenience and clarity, the term "nano-crystal" is used.

Nano-crystals are well known in the art, and have been manufactured from a variety of materials, typically metals. Nano-crystals have (photon) absorption and fluorescence properties that are size and material dependent. Those skilled in the art can produce such crystals in quantity with tailored absorption and fluorescence characteristics.

Nano-crystals for use in conjunction with the present invention are advantageously engineered to absorb photons having a particular wavelength, and re-radiate photons at another, typically longer wavelength. The absorption wavelength is selected to match the operating wavelength of a detection and ranging system. Typically, LDR systems operate in the infrared region of the electromagnetic spectrum. The infrared region extends from about 780 nm to 1.00 mm, and is often subdivided into four regions: the near IR (i.e., near visible) at 780–3000 nm, the intermediate IR at 3000–6000 nm, the far IR at 6000–15000 nm, and the extreme IR at 15000 nm–1.0 mm. Most atmospheric LDR systems operate in the near or intermediate range (i.e., 780–6000 nm).

For use underwater, LDR systems will operate at blue-green wavelengths (about 458 nm to 514 nm), since these wavelengths fall in a narrow transmission window for light through water. Light having a different wavelength is rapidly absorbed by water.

The ability of a suitably engineered nano-crystal to absorb a photon having a first wavelength $\lambda_1$ and re-radiate a photon having a second wavelength $\lambda_2$ is important for its use as an obscurant in accordance with the illustrative embodiment of the present invention. In particular, LDR systems are not typically capable of detecting light having a wavelength that is different from that of the interrogating beam. To the extent that an LDR system directs an interrogating light beam having a wavelength $\lambda_1$ into a cloud of nano-crystals that is capable of absorbing those photons and re-radiating photons having a different wavelength $\lambda_2$, the LDR will not be able to sense the returned light. Consequently, the LDR system will not be able to detect the cloud of nano-crystals. As described later in this specification and as illustrated in the appended Figures, to the extent that the cloud of nano-crystals is interposed between the LDR system and a vehicle, the vehicle will not be detectable by the LDR system (assuming that the nano-crystals absorb substantially all incoming light energy).

Due to their exceedingly small size, a very small amount of nano-crystals provide a large area of protection for a vehicle. In particular, the resonant cross section of a nano-crystal is about $1.2\times10^{-10}$ square meters per particle. This provides a coverage area of about $5.5\times10^{10}$ square meters per cubic meter or about $1\times10^{4}$ square meters per gram of nano-crystals. Many kilograms of smoke would be required to provide the same amount of coverage area as a gram of nano-crystals.

The optical behavior (absorption and fluorescence) of a nano-crystal is primarily a function of its size (for a given material). In other words, a nano-crystal can be "tuned" to absorb or fluoresce at a specific wavelength by varying crystallite size. As the size of a nano-crystal decreases, as controlled by its preparation method, its band gap shifts to higher energies due to the quantum size effect. Absorption and luminescence spectroscopy enables the shift in band gap to be determined. Consequently, with routine experimentation as to crystal size, nano-crystals can be engineered to provide a desired wavelength selectivity (i.e., absorb at a desired wavelength or fluoresce at a desired wavelength). There is a limited ability to independently control absorption and fluorescence wavelength. In particular, by varying crystallite size and material, a different set of characteristic absorption and fluorescence wavelengths are obtained.

In some embodiments, the nano-crystals are engineered to provide a relatively small shift in fluorescence wavelength. This can be done, for example, by producing the nano-crystals from a semiconductor material that has had its bandgap adjusted, in known fashion, to be near and slightly below the laser's photon energy.

For most applications, the nano-crystal is engineered to absorb at the operating wavelength of a LDR system (i.e., typically near infrared—the specific operating wavelength of most military systems is secret) without regard to fluorescence wavelength (since there is little ability to independently control the fluorescence wavelength).

Crystals having a size that is between about 10 to 100 percent of the wavelength of the laser light to be absorbed are advantageously used. A particularly strong absorption is often observed for crystals having a size that is about 50 percent of the wavelength of the interrogating laser beam. The term "size," when used in the context of nano-crystals, refers to the largest dimension along the three crystal axes. Often, when dealing with light, the expression $k_d=2\pi d/\lambda$, is used to provide a crystal diameter.

The preferred crystallite size will depend upon the physical shape and composition of the nano-crystal, and are determined by simple experimentation. Specifically, crystals are grown to a particular size, in known fashion, and then segregated by size. The different-size crystals are exposed to laser light at the wavelength of interest and the absorption and fluorescence wavelengths are determined in known fashion. The crystal having the most desirable absorption and/or fluorescence characteristics is then selected.

Nano-crystals have been prepared for most metals, both pure (e.g., platinum, palladium, gold, silver, nickel and copper etc.) and alloys (e.g., silver/palladium, silver/gold, silver/platinum, nickel/copper, nickel aluminum, etc.), diamond, carbon, and as a variety of oxides (e.g., $ZnGa_2O_4$, $TiO_2$, $Fe_2O_3$, ZnO, $GeO_2$), etc. A number of preparation methods are known to those skilled in the art. Nanoc-crystals are commercially available from a variety of sources, such as Cima NanoTech, Woodbury, Minn.

Nano-crystals for use in conjunction with the illustrative embodiment of the present invention are advantageously coated for protection from oxidation and chemical attack. The coating will enable use of the nano-crystals in harsh environments and provide a long shelf life. The coating can be suitably selected from polyethylene glycol, peptides, trioctylphosphine, dithiol, thiol, xylenedithiol and glass, among others.

As previously indicated, micron-scale spheres ("micro-spheres") can be used as taggants and obscurants in conjunction with the illustrative embodiment of the present invention. The spheres are advantageously transparent and made of a dielectric material (e.g., glass, plastic, etc.). The micro-spheres capture light based on a difference in refractive index between the ambient environment and the micro-spheres. Glass micro-spheres will have a refractive index in the range of about 1.3 to 1.6, and plastic micro-spheres will have a refractive index that is somewhat less than 1.3.

In some embodiments, the micro spheres are doped with one or more materials (metals, rare-earth metals, etc.). The dopant is advantageously selected to provide a particular fluorescence behavior. For example, in some embodiments, the dopant is selected so that the micro-spheres radiate photons having a wavelength that is different from the wavelength of incoming photons, in the manner of appropriately-engineered nano-crystals, as previously described. In some other embodiments, the dopant system "traps" the fluorescent photon (i.e., produces a geometry-induced forbidden transition for the fluorescent photon), degrading it to much longer wavelengths (i.e., heat). In either case, the very high quality factor or "Q" of the micro-spheres provides an efficient transfer of energy to the dopant, wherein the character of the (re)-emitted electromagnetic energy is changed.

The optical behavior of micro-spheres can also be controlled by their size. For example, size can be chosen so that the micro-sphere is anti-resonant for the light that is produced by fluorescence (due to a dopant).

The high "Q" (quality factor) of micro-spheres indicates that they will be very efficient light scatters. Un-doped micro-spheres will return light at the same wavelength as it is received. Consequently, in some embodiments, un-doped micro-spheres are used as taggants. Also, un-doped micro-spheres are not wavelength selective in the sense that they will capture interrogating light having any of a variety of wavelengths.

Micro-spheres for use in conjunction with the present invention will typically have a diameter that is less than about 10 microns and greater than about 100 nanometers (0.1 microns). As for the nano-crystals, micro-sphere size is best determined by experimentation with regard to a specific wavelength of incoming light.

It is contemplated that other very small, engineered particles can be used as obscurant or taggant. For example, if it were possible to create a nano-sphere (i.e., nanometer-scale sphere), which at present it is not, they could be used.

Having described two types of particles (i.e., nano-crystals and micro-spheres) that are suitable for use in conjunction with the present invention, a method for obscuring or tagging a vehicle using these particles is now described.

Figure 2:
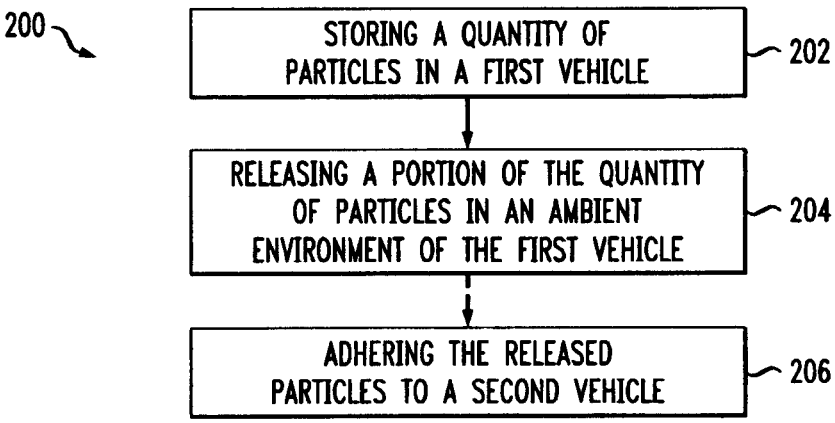
FIG. 2 depicts a flow diagram of a method in accordance with the illustrative embodiment of the present invention. The method involves the use of particles, which can be made to function as obscurants and taggants to frustrate or enhance, respectively, the operation of an LDR system.

FIG. 2 depicts a flow diagram of method 200 in accordance with the illustrative embodiment of the present invention. In some embodiments, method 200 comprises:

Task 202—storing a quantity of particles in a first vehicle.

Task 204—releasing a portion of the particles in an ambient environment of the first vehicle.

With regard to task 202, particles are stored (e.g., in a container, compartment, etc.) within a vehicle. The term "vehicle" has been defined above to include, without limitation, land vehicles, aircraft, and seafaring vessels. Typically, the vehicle will be in use in military service.

It will be appreciated that the manner in which the particles are deployed is somewhat application specific. For example, when used as an obscurant, the particles will typically be ejected from the vehicle via a puff of air or explosively. For deployment from a submarine, the particles will typically be released upstream of the screw (i.e., the propellers) to take advantage of the turbulence that is provided by the screw to disperse the particles in the water. When the particles are being deployed by a surface ship for use as taggant (e.g., for a submarine, etc.), they are, in some embodiments, released underwater from a canister. The particles can be dispersed in the form of a column (vertically) by lowering/raising the canister from a stationary ship, or in the form of a layer (horizontally) by dragging the canister from a moving ship.

In some embodiments, method 200 includes an additional task—task 206, which is to adhere the released particles to a second vehicle. Task 206 is described in more detail later in this specification.

Figure 3:
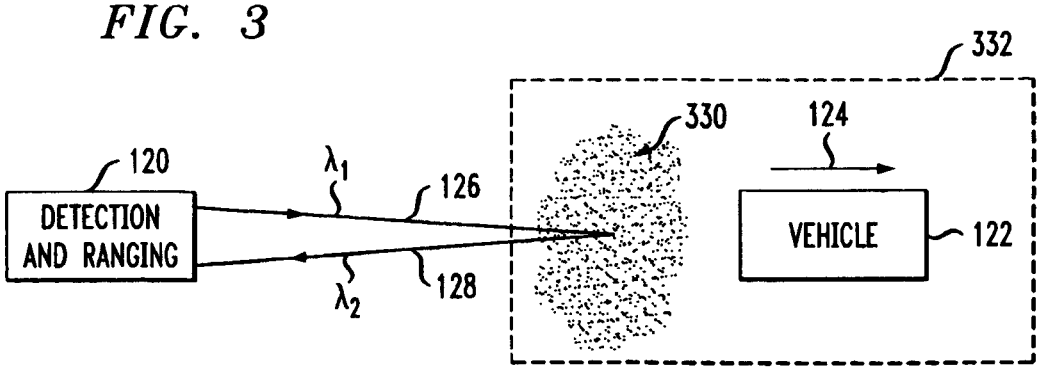
FIG. 3 depicts a way in which an obscurant or taggant is used, in accordance with the method of FIG. 2.

FIG. 3 depicts using particles as an obscurant or taggant, in accordance with the method of FIG. 2. As depicted in FIG. 3, vehicle 122, which has a supply of particles 330 and is moving in direction 124, releases a portion of particles 330 in ambient environment 332. LDR system 120 directs a laser beam having a wavelength $\lambda_1$ toward vehicle 122. The laser light is absorbed by particles 330. Light having a wavelength $\lambda_2$ is radiated from particles 330 and is received by LDR system 120. Since LDR system 120 is not capable of detecting light have a wavelength $\lambda_2$, vehicle 122 is not detected.

It is noted that the inability to detect light at wavelength $\lambda_2$ is not a technical limitation per se; rather, it is due to an inability to predict the wavelength of the back-scattered light. In other words, detection is problematic because it is not known where (i.e., at what wavelength) to look.

Figure 4:
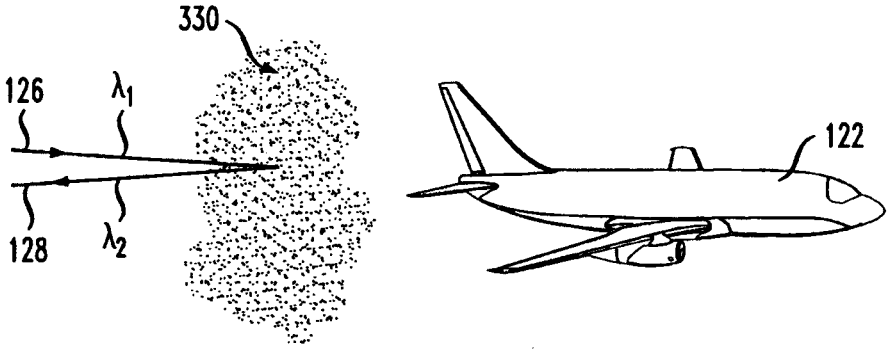
FIG. 4 depicts an aircraft practicing the method depicted in FIGS. 2 and 3, wherein the particles are used as an obscurant.
Figure 5:
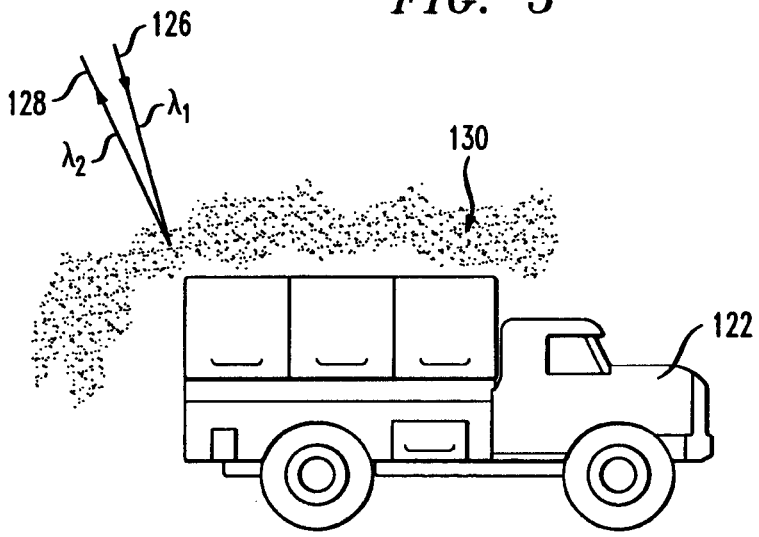
FIG. 5 depicts a land vehicle practicing the method depicted in FIGS. 2 and 3, wherein the particles are used as an obscurant.
Figure 6:
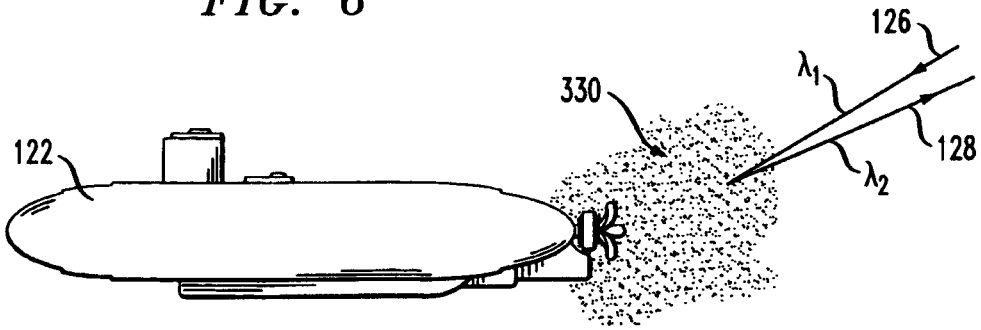
FIG. 6 depicts a submarine practicing the method depicted in FIGS. 2 and 3, wherein the particles are used as an obscurant.

FIGS. 4, 5 and 6 provide examples of different types of vehicles practicing the method depicted in FIGS. 2 and 3. In the embodiment depicted in these Figures, the particles are used as an obscurant.

In further detail, FIGS. 4, 5, and 6 depict particles 330 that have been released from aircraft 122, land vehicle 122, and submarine 122, respectively. Particles 330 have been engineered to absorb light having a wavelength $\lambda_1$ and radiate light 128 having a different wavelength $\lambda_2$. Consequently, nano-crystals or appropriately-doped micro-spheres can be used.

An LDR system (not shown) directs a beam of light 126 having wavelength $\lambda_1$ towards vehicle 122. Light beam 126 is intercepted and absorbed by particles 330, and the absorbed energy is re-radiated as photons having wavelength $\lambda_2$. Since the LDR system cannot reliably detect light having wavelength $\lambda_2$, the vehicle (i.e., aircraft 122, land vehicle 122, and submarine 122) is neither detected nor ranged.

Figure 7:
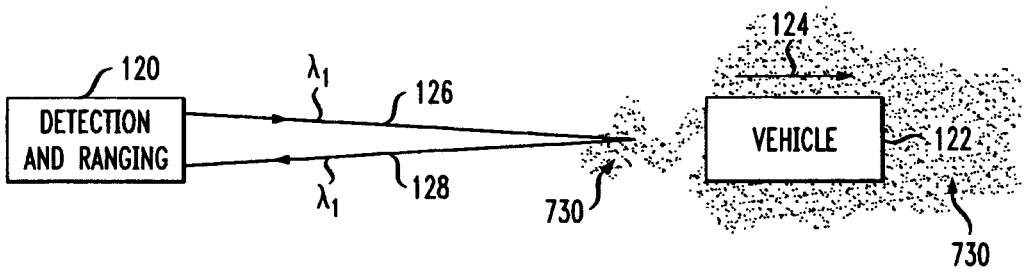
FIG. 7 depicts a way in which a taggant is used, in accordance with the method of FIG. 2, to enhance the performance of an LDR system.

FIG. 7 depicts a way of using particles as taggant, in accordance with method 200 of FIG. 2. As depicted in FIG. 7, vehicle 122 passes through a region containing a plurality of particles 330. The particles, which for this variation are advantageously transparent and un-doped micro-spheres, have been deployed by some other vehicle (not shown). Passage of vehicle 122 through the ambient medium (e.g., typically air or water) creates a disturbance that is evidenced by movement of particles 330. The disturbance will have certain defined characteristics based on the medium and the type of vehicle 122.

LDR system 120 interrogates particles 330 with light beam 126 having wavelength $\lambda_1$. Particles 330 receive light beam 126 and scatter it, returning light 128 at the same wavelength $\lambda_1$. The returned light, once suitably analyzed, will indicate the presence of vehicle 122 and, in some cases, provide an identifying signature, as described further below.

Figure 8:
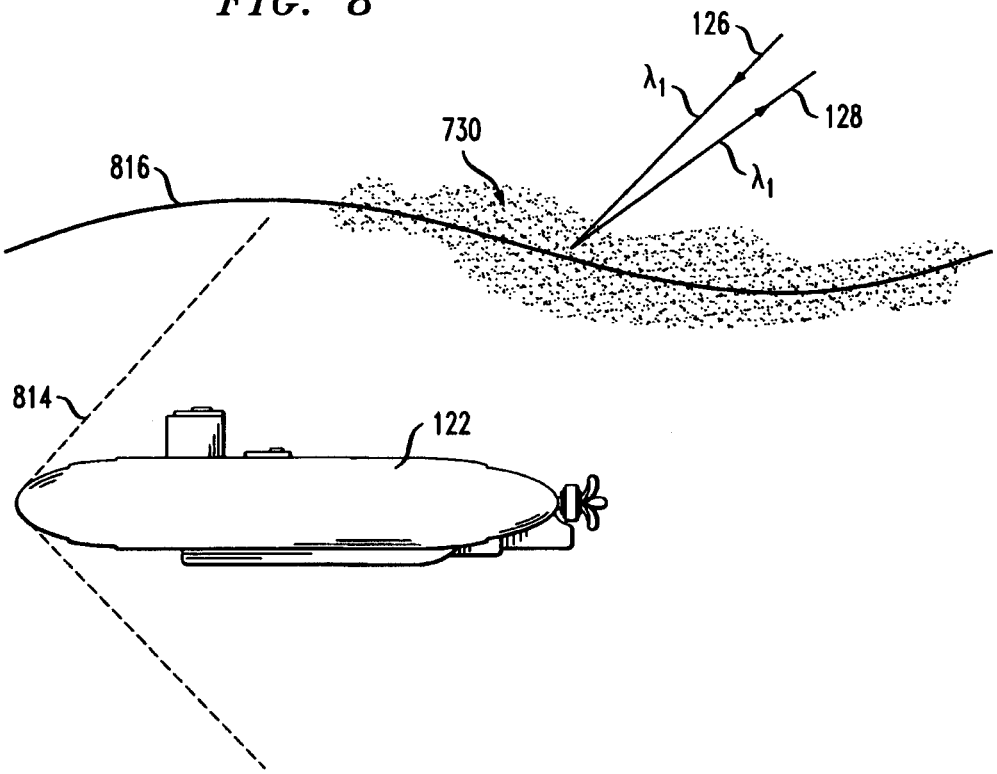
FIG. 8 depicts a first way in which a taggant is used to detect the presence of a submarine, in accordance with the method depicted in FIGS. 2 and 7.
Figure 9:
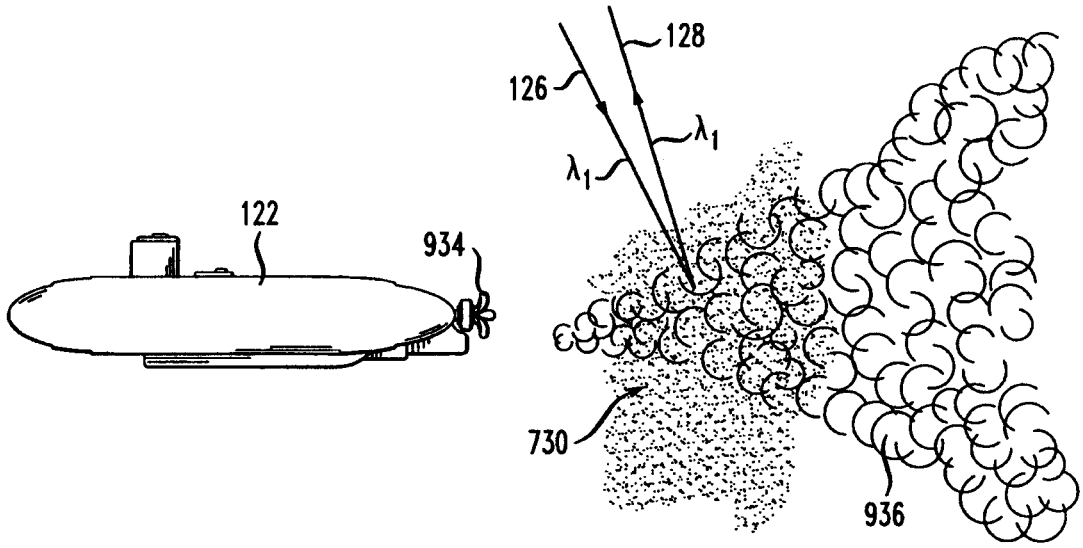
FIG. 9 depicts a second way in which a taggant is used to detect the presence of a submarine, in accordance with the method depicted in FIGS. 2 and 7.

FIGS. 8 and 9 illustrate a vehicle 122 practicing the method depicted in FIGS. 2 and 7. For the embodiment illustrated by these Figures, the particles are used as a taggant.

More particularly, FIG. 8 depicts particles 330 that have been released underwater from a ship (not depicted). The particles, realized in this embodiment as transparent micro-spheres, are advantageously engineered to be neutrally buoyant, such as by coating them with transparent plastic and including air pockets, as required. As previously described, such particles efficiently scatter light, wherein the scattered light 128 has the same wavelength $\lambda_1$ as the interrogating light beam 126.

Particles 330 are advantageously dispersed in a layer. Movement of submarine 122 through the water creates disturbance 814, which is known to cause large-amplitude submerged waves 816. An LDR system (not depicted) that operates at blue-green wavelengths can readily detect movement of particles 330, as caused by waves 816.

Like FIG. 8, FIG. 9 depicts particles 330 that have been released underwater from a ship (not depicted). Again, the particles are advantageously transparent micro-spheres that are engineered to be neutrally buoyant. Screw 934 causes wake vortices 936. An LDR system (not depicted) directs light beam 126, having wavelength $\lambda_1$, in the direction of the submarine. Light 128 scattered by particles 330 has the same wavelength $\lambda_1$ as interrogating light beam 126. An LDR system (not depicted) that operates at blue-green wavelengths can readily detect movement of particles 330, as caused by wake vortices 936.

Figure 10:
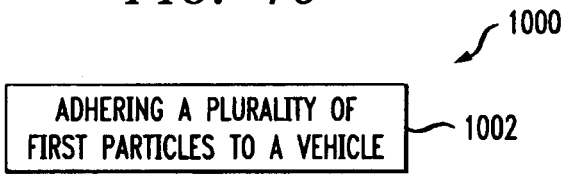
FIG. 10 depicts a flow diagram of a variation of the method depicted in FIG. 2

FIG. 10 depicts a flow diagram of method 1000, which is a variation of method 200 depicted in FIG. 2. Method 1000 recites a single task 1002 of "adhering a plurality of particles to a vehicle."

Figure 11:
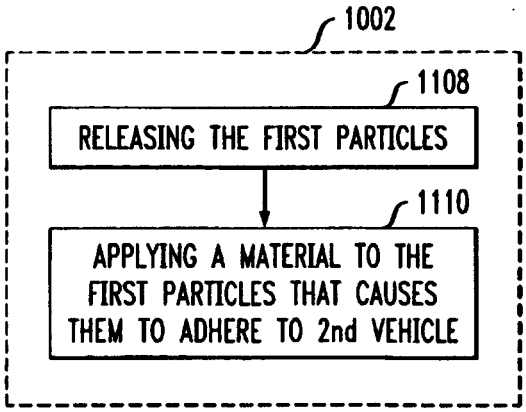
FIG. 11 depicts a flow diagram of subtasks of task 206 (of method 200) and subtasks of task 1002 (of method 1000).

FIG. 11 depicts one variation of task 1002, wherein subtasks of task 1002 include:

Subtask 1108—releasing the first particles.

Subtask 1110—applying a material to the first particles that causes them to adhere to a vehicle.

In subtask 1108, particles are released from a first vehicle. In subtask 1110, a material is applied (e.g., sprayed, etc.) to the particles on release, wherein the material causes the particles to adhere to a second vehicle. In other words, the material functions as an adhesive to render the particles "sticky." The sticky particles are dispersed into the environment and, on contact with a second vehicle, adhere to it. (It is noted that subtask 1110 is also a subtask of task 206.)

The material functioning as the adhesive is application specific. In other words, the material is selected to react with the exterior of the target vehicle. For example, in some embodiments in which the particles are to be adhered to a submarine, the particles are coated with antibodies. This can cause the particles to adhere to the bio-film on the hull of the submarine. Dithiol-coated particles will adhere to bare metal. Those skilled in the art can suitably select an adhesive material as a function of the target.

The variation of task 1002 depicted in FIG. 11 uses particles as taggants. That is, particles are dispersed into the environment, such as in the manner described in FIGS. 8 and 9. When the particles contact a vehicle, they adhere to it.

Figure 12:
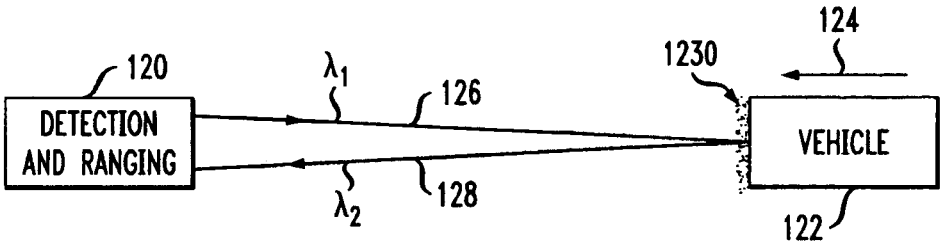
FIG. 12 depicts a way in which an obscurant or taggant is used, in accordance with the methods depicted in FIGS. 2 and 10.

FIG. 12 depicts an embodiment of the method described in FIGS. 2, 10, and 11, wherein particles are adhered to vessel 122. In this embodiment, the particles are engineered to absorb light at wavelength $\lambda_1$ and radiate light at wavelength $\lambda_2$ (e.g., using nano-crystals, doped micro-spheres, etc.) For this embodiment, LDR system 120 is operative to generate and direct an interrogating beam of light 126 having wavelength $\lambda_1$ and receive and detect a light beam having wavelength $\lambda_2$. LDR system 120 directs beam 126 toward vehicle 122. Particles 330 absorb light 126 and radiate light 128 having wavelength $\lambda_2$. The radiated light 128 is detected by LDR system 120 and vehicle 122 is detected and ranged.

Figure 13:
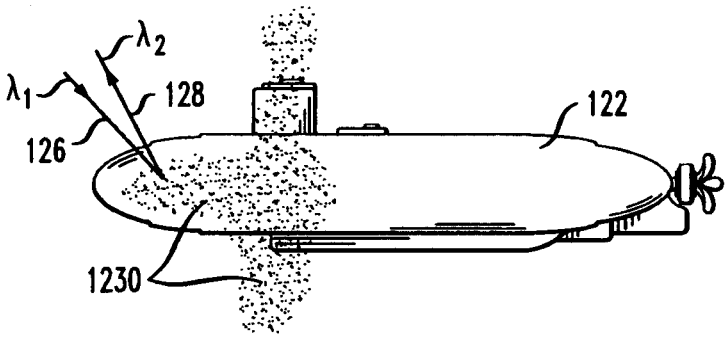
FIG. 13 depicts a way in which a taggant is used to detect a submarine, in accordance with the methods depicted in FIGS. 2, 10, and 11.

FIG. 13 depicts an embodiment of the method described in FIGS. 2, 10, 11 and 12, wherein submarine 122 passes through a plurality of particles 330 that were deployed from a surface ship (not depicted). At least some of particles 330 adhere to the hull of submarine 122. Light beam 126 from an LDR system (not depicted) interrogates the hull of submarine 122. Particles 330 absorb light 126 having wavelength $\lambda_1$ and radiates photons at wavelength $\lambda_2$. Light 128, which comprises the radiated photons, is detected by the LDR system. In this fashion, the particles are used as a taggant to aid in the detection and ranging of submarine 122.

Figure 14:
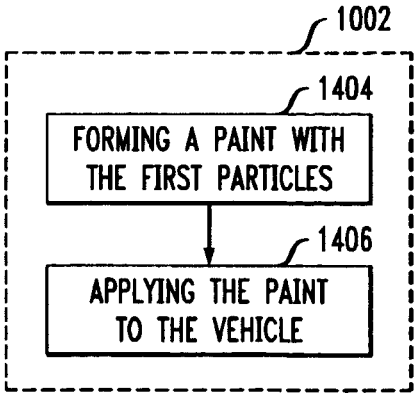
FIG. 14 depicts a flow diagram of subtasks of task 1002 (of method 1000).

FIG. 14 depicts a second variation of task 1002, wherein subtasks of task 1002 include:

Subtask 1404—forming paint with the first particles.

Subtask 1406—applying the paint to a vehicle.

In subtask 1404, particles are mixed with paint that is advantageously transparent at the interrogation wavelength. The more likely application for this variation is to obscure the vehicle; consequently, the particles are engineered to absorb light having wavelength $\lambda_2$ and radiate photons at wavelength $\lambda_2$. Once the paint is prepared, it is applied to the vehicle.

Figure 15:
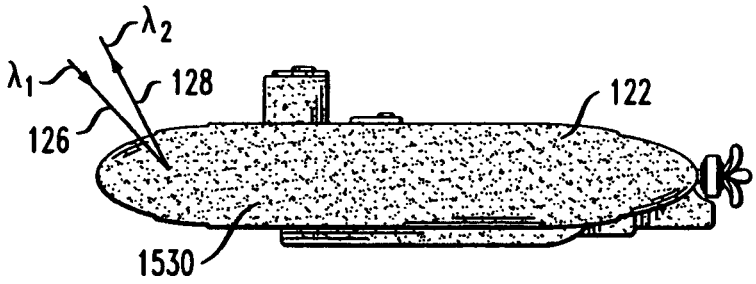
FIG. 15 depicts a way in which an obsurant is used by a submarine, in accordance with the methods depicted in FIGS. 10 and 14.

FIG. 15 depicts an embodiment of the method described in FIGS. 2, 10, 12, and 14, wherein submarine 122 has been painted with a paint that contains particles in accordance with the method shown in FIG. 14. Light 126 having wavelength $\lambda_1$ in the blue-green range is received by particles 330 in the paint. The particles radiate light 128 at a non blue-green wavelength $\lambda_2$, which is rapidly absorbed by the water.

The variation of the illustrative embodiment that is depicted in FIG. 14 can be used in any environment, but will be particularly effective for protecting submarines from LDR systems operating at blue-green wavelengths, as depicted in FIG. 15. As previously indicated, there is a narrow transmission window for light through water. The particles should be designed so that the fluorescence wavelength is outside of this window. Consequently, any photons radiated from the particles will be rapidly absorbed by the water.

Figure 16:
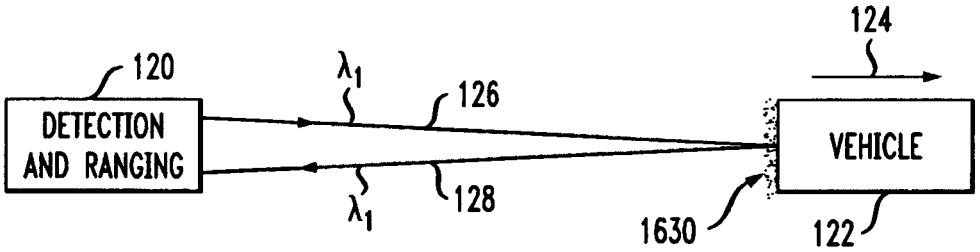
FIG. 16 depicts a way in which a taggant is used, in accordance with the method FIGS. 2, 10, and 11.

FIG. 16 depicts a variation of the illustrative embodiment that is similar to the one depicted in FIG. 12, except that particles 330, which adhere to vehicle 122, scatter light 128 having the same wavelength $\lambda_1$ and as interrogating light beam 126.

Figure 17:
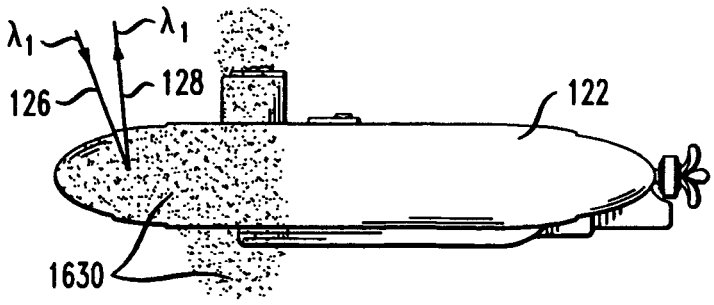
FIG. 17 depicts a way in which a taggant is used by a submarine, in accordance with the method of FIGS. 2, 10, 11, and 16.

FIG. 17 depicts an embodiment of the method described in FIGS. 2, 10, 11 and 16, wherein submarine 122 passes through a column of particles 330 that were deployed from a ship (not depicted). At least some of particles 330 adhere to the hull of submarine 122. Light beam 126 from an LDR system (not depicted) interrogates the hull of submarine 122. Particles 330 receive light 126 having wavelength $\lambda_1$ and scatter light 128 at the same wavelength $\lambda_1$. Light 128 is detected by the LDR system. In this fashion, the particles are used as a taggant to aid in the detection and ranging of submarine 122.

It is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

I claim:

1. A method comprising:

storing a quantity of a first type of particles in a first vehicle, wherein said first type of particles are capable of absorbing electromagnetic energy having a first wavelength and re-radiating electromagnetic energy having a second wavelength that is different from said first wavelength; and releasing a portion of said quantity of said first type of particles in an ambient environment of said first vehicle.

2. The method of claim 1 further comprising the task of adhering the released portion of said first particles to a second vehicle.

3. The method of claim 1 further comprising the task of applying a material to said first particles as they are released into said ambient environment, wherein when said first particles contact a second vehicle, said material causes said first particles to adhere to said second vehicle.

4. The method of claim 1 wherein said first vehicle is a submarine and the task of releasing further comprises releasing said first particles into water upstream of a screw of said submarine.

5. The method of claim 1 wherein said first vehicle is a surface ship and the task of releasing further comprises releasing said first particles into water.

6. The method of claim 1 wherein said first vehicle is an aircraft and the task of releasing further comprises releasing said first particles into air.

7. The method of claim 1 wherein said first vehicle is a land vehicle and the task of releasing further comprises releasing said first particles into air.

8. The method of claim 1 wherein said second wavelength is longer than said first wavelength.

9. The method of claim 8 wherein said second wavelength is less than about one percent longer than said first wavelength.

10. The method of claim 1 wherein said first wavelength is in a range selected from infrared wavelengths and blue-green wavelengths.

11. The method of claim 1 wherein said first type of particles have a first size that is in a range of about one-tenth to one times said first wavelength.

12. The method of claim 1 wherein said first type of particles have a first size that is about one-half of said first wavelength.

13. The method of claim 1 wherein said first type of particles have a first size that is less than 1000 nanometers.

14. The method of claim 1 wherein said first type of particles have a first size that is less than 500 nanometers.

15. The method of claim 1 wherein said first type of particles have a first size that is less than 100 nanometers.

16. The method of claim 1 wherein said first type of particles are metallic.

17. The method of claim 16 wherein said first type of particles are coated to resist oxidation and chemical attack.

18. The method of claim 16 wherein said portion of released particles is less than about five grams.

19. The method of claim 1 wherein said first type of particles comprise a transparent, dielectric material and a metal dopant.

20. The method of claim 19 wherein said first type of particle has a size that is in a range of about 1 micron to 10 microns.

21. The method of claim 19 wherein said portion of released particles is within a range of about 50 grams to 100 grams.

22. A method comprising:

releasing particles in a medium, wherein said particles have a non-random, substantially uniform size that is in a range of about 10 microns or less;

interrogating said particles with electromagnetic radiation having a first wavelength; and detecting a vehicle based on the interrogation of said particles, wherein said vehicle is indicated by characteristic movements of said particles within said medium, wherein said characteristic movements are a based on said medium and said vehicle.

23. The method of claim 22 wherein said particles scatter said electromagnetic radiation, and wherein said scattered electromagnetic radiation has said first wavelength.

24. The method of claim 22 wherein said medium is selected from the group consisting of air and water.

25. The method of claim 22 wherein the operation of detecting a vehicle further comprises obtaining an identifying signature of said vehicle from said characteristic movements of said particles.

26. The method of claim 22 wherein said particles are selected from the group consisting of nano-crystals, doped micron-scale transparent spheres, and undoped micron-scale transparent spheres.

27. The method of claim 26 wherein said said doped micron-scale transparent spheres comprise a dopant that provides a first fluorescence behavior.

28. The method of claim 27 wherein said first fluorescence behavior comprises radiating photons having a wavelength that is different from said first wavelength.

29. The method of claim 27 wherein said fluorescence behavior comprises producing a forbidden transition for a fluorescing photon, degrading it to heat.

30. The method of claim 22 wherein said size is less than 100 nanometers.

31. The method of claim 22 wherein said size is in a range of about 1 micron to 10 microns, and wherein said particles comprise a transparent, dielectric material.

32. A method comprising adhering a plurality of particles to an exterior of a first vehicle, wherein said first particles have a non-random, substantially uniform size that is in a range of about 10 microns or less; and wherein said first particles affect electromagnetic radiation that they receive in one of the following ways:

by re-radiating electromagnetic radiation, but at a wavelength that is different than a wavelength of the received electromagnetic radiation; and by scattering electromagnetic radiation, wherein scattered electromagnetic radiation has substantially the same wavelength as the received electromagnetic radiation.

33. The method of claim 32 wherein adhering further comprises applying a paint to said exterior of said first vehicle, wherein said paint contains said first particles.

34. The method of claim 32 wherein adhering further comprises:

releasing said first particles from a second vehicle; and applying a material to said first particles as they are released from said second vehicle, wherein when said first particles contact said first vehicle, said material causes said first particles to adhere to first vehicle.

* * * * *